United States Patent [19]

Sando et al.

[11] Patent Number: 4,557,006

[45] Date of Patent: Dec. 10, 1985

[54] METHOD FOR SETTING AND PRETREATING A CLOTH

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 651,117

[22] Filed: Sep. 14, 1984

[30] Foreign Application Priority Data

Sep. 16, 1983 [JP] Japan ..... 58-170685

[51] Int. Cl.[4] ..... D06B 3/12

[52] U.S. Cl. ..... 8/149.1; 68/5 E

[58] Field of Search ..... 8/149.1, 149.3; 68/5 D, 68/5 E, 175

[56] References Cited

U.S. PATENT DOCUMENTS 4,416,123 11/1983 Sando et al. ..... 68/5 E
4,416,124 11/1983 Godau ..... 68/175 X

FOREIGN PATENT DOCUMENTS 863219 3/1961 United Kingdom ..... 68/5 E
2091767 8/1982 United Kingdom ..... 8/149.1

*Primary Examiner*—Philip R. Coe
*Attorney, Agent, or Firm*—Toren, McGeady, Stanger, Goldberg & Kiel

[57] ABSTRACT

A method for setting and pretreating a cloth by a continuous process which comprises supplying a long cloth soaked with a treating solution continuously into a steamer body by piling up several sheets one on top of the other, separating these sheets, and then steaming each cloth while applying a high temperature treating solution thereto and widening the sheets for setting the cloth. Then the cloth is steamed by piling up the sheets once again during application of the high temperature treating solution still further thereto for pretreatment of the cloth. Then with the use of washing water, the cloth is washed and then finally taken out of the steamer body. A long cloth can effectively and economically be set and pretreated while sparing heat energy and water resource.

4 Claims, 1 Drawing Figure

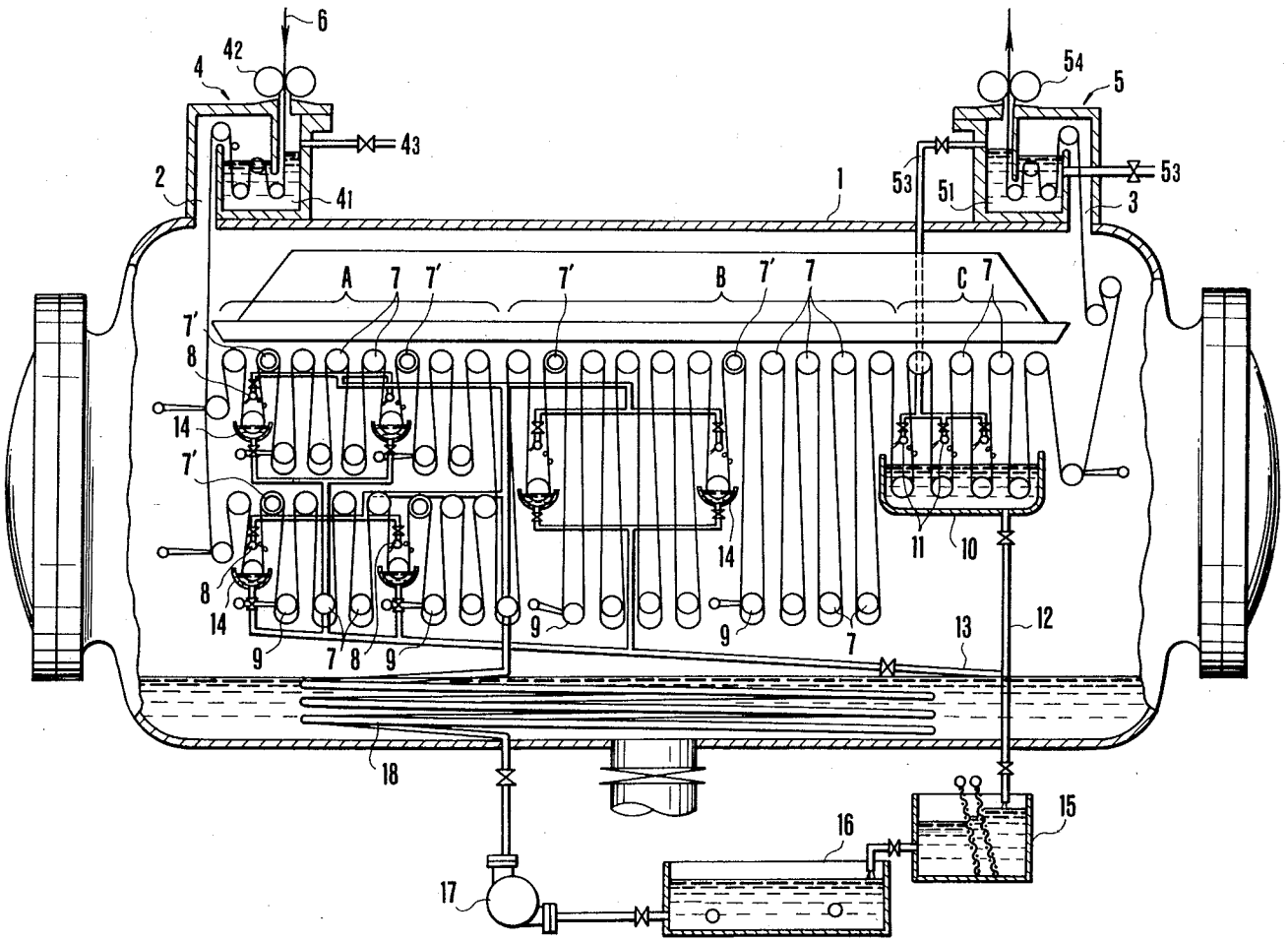
1
2
3
4
5
6
7
7'
8
9
10
11
12
13
14
15
16
17
18
A
B
C
41
42
43
51
53
54

METHOD FOR SETTING AND PRETREATING A CLOTH

BACKGROUND OF THE INVENTION

1. Field of the Invention

The present invention relates to a method for setting and pretreating a cloth in which several sheets of the cloth can simultaneously be pretreated while sparing heat energy and water resource.

2. Description of the Prior Arts

It is well known in the art to use a high pressure steamer such as the one developed by the present inventors for the subjection of a long cloth commercially produced to such treatments as desizing, scouring and setting, continuously. The process comprises the passing of a cloth to be treated through a treating solution stored in a solution tank provided outside of a high pressure steamer body or a liquid seal tank at the inlet side seal mechanism of a steamer body, and then subjection of the resultant cloth to steaming and boiling continuously in the high pressure steamer body.

In this instance, however, since the high temperature waste treating solution which is exhausted out of the steamer body successively is abandoned, there is not only a loss of the treating agent but also the waste of heat energy. Further, since slow cooling water must be successively supplied into the slow cooling tank provided at the outlet side seal mechanism of the steamer body, the loss of water for cooling is also remarkable. Moreover, since the cloth is treated as a single sheet, there is a problem in productivity.

SUMMARY OF THE INVENTION

Under such circumstances, the object of the present invention is to offer a skillful method for setting and pretreating a long cloth commercially produced, in which several sheets of the cloth pilled up one on top of the other are simultaneously treated for increasing productivity, and the heat, treating solution and water used for the treatment are employed repeatedly for the purpose of sparing treating agent, heat energy and water resource.

The principle of the inventive method comprises the supply of a cloth soaked with a treating solution into a steamer body by piling up several sheets together, setting of the cloth by separating the sheets from one another, and then pretreatment and washing of the cloth by piling the sheets up once again. The excess of treating solution and waste washing water from the steamer body are recovered for reuse in preparation of the treating solution.

BRIEF EXPLANATION OF THE DRAWING

The drawing is an explanatory drawing showing an example of the apparatus to be used in the present invention.

DETAILED DESCRIPTION OF THE EMBODIMENT

The embodiment of the present invention will be illustrated in detail in the following with reference to the drawing as above-mentioned. This apparatus is for the treatment of two sheets of a cloth en bloc.

In the drawing, 1 is a high pressure steamer body for the wet heat treatment of a cloth continuously. This high pressure steamer body is provided with a cloth inlet 2 and a cloth outlet 3, respectively having an inlet side seal mechanism 4 and an outlet side seal mechanism 5, for maintaining the interior of the steamer body 1 with high pressure wet heat, for example, at a temperature in the range from 100° C. to 160° C. while transporting a cloth 6 to be treated continuously through the steamer body. The inlet side seal mechanism 4 comprises a liquid seal tank $4_1$ for introducing a treating solution therein so as to soak the cloth 6 with the treating solution, a pair of seal rubber rollers $4_2$ for sealing the upper opening of the liquid seal tank $4_1$, and a treating solution supply pipe $4_3$ for supplying the treating solution into the liquid seal tank $4_1$. The outlet side seal mechanism 5 comprises a nearly U-shaped slow cooling tank $5_1$ for introducing cooling water therein so as to cool the cloth slowly with the cooling water, a cooling water discharge pipe $5_3$, and a pair of seal rubber rollers $5_4$ for sealing the upper opening of the slow cooling tank $5_1$. It is designed so that the temperature of the cooling water becomes nearly 50° C. at the outlet of the slow cooling tank $5_1$ by controlling the temperature and amount of the cooling water supplied.

While a plurality of guide rollers 7 are provided in the steamer body 1 for transportation of two sheets of the cloth en bloc a zigzag motion therethrough by the formation of up and down snake-like undulations, the interior of the steamer body 1 is divided into three zones; the setting zone A, the pretreating zone B and the washing zone C. The guide rollers in the setting zone A are provided in two series for transportation of each of the sheets separately therethrough and the guide rollers in the pretreating zone B and the washing zone C are provided singly for transporting two sheets of the cloth en bloc therethrough. In the setting zone A and the pretreating zone B, a plurality of nozzles 8 are provided for propelling the high temperature treating solution onto the cloth 6 transported by means of the guide rollers 7, and a plurality of saucers 14 are provided respectively under each of the nozzles 8 for receiving the excess of treating solution propelled from the nozzles 8 to the cloth. In the setting zone A, since each of the sheets of cloth is transported separately therethrough, it is designed so that the treating solution as well is propelled to each of the sheets separately. The guide rollers 7 include open width rollers 7' denoted with double circles in the drawing for the prevention of shrinkage of the cloth in its width direction and the formation of creases in the cloth by applying a tension in the width direction of the cloth immediately after the treating solution is propelled from the nozzles 8 to the cloth each time. 9 represents tension control rollers for maintaining a suitable contact pressure between the cloth and the guide rollers 7 including the open width rollers 7' by applying an appropriate tension to the lengthwise direction of the cloth running through the wet heat treatment chamber 1.

10 is a washing tank provided in the washing zone C as above-mentioned. It is designed so that the cooling water exhausted from the slow cooling tank $5_1$ is propelled via nozzles 11 to the cloth in the washing tank 10. 12 is a water exhaust pipe, to exhaust waste water from the washing tank 10, and 13 is a treating solution exhaust pipe to exhaust the treating solution from the saucers 14. The waste water coming from the water exhaust pipe 12 and the treating solution coming from the treating solution exhaust pipe 13 are put together, filtered by passing through a filter 15 and stored in a liquid storage tank 16 for the preparation of the treating solution. The treating solution prepared in the liquid storage tank 16 is passed through a heat exchange pipe 18 by means of a pump 17, where it is heated up to a temperature approximately of the temperature in the interior of the steamer body, for example at about 150° C., and propelled by means of the nozzles 8 to the cloth 6 passing through the steamer body 1.

The construction of an example of the apparatus for treating two sheets of a cloth en bloc in the present invention is as described above. The construction of an apparatus for treating more than two sheets of a cloth en bloc may easily be understood therefrom. Now, an example of the setting and pretreatment of a cloth in the present invention by using this apparatus will be shown in the following.

At first, the interior of the high pressure steamer body 1 is maintained with high pressure wet heat at a temperature of, for example, 160° C. by blowing pressurized high temperature steam therein. Separately, a treating solution is stored in the liquid storage tank 16, and a part of the solution is supplied in the liquid seal tank $4_1$ of the inlet side seal mechanism 4 by means of a suitable piping (not shown in the drawing). The treating solution is usually comprised of an aqueous caustic alkali solution. The slow cooling tank $5_1$ of the outlet side seal mechanism 5 and the washing tank 10 in the zone C are filled with water.

Now, two sheets of a cloth 6 piled on top of each other are supplied continuously in the interior of the steamer body 1 by driving the guide rollers 7 and open width rollers 7'. The sheets are passed shortly through the setting zone A in a separated state, where each of the sheets is soaked further sufficiently with the treating solution heated to a temperature of approximately up to 150° C. and propelled to each of the sheets by means of the nozzles 8, and the sheets are wet heat treated due to the effect of the wet heat in the steamer body and widened due to the widening effect of the open width rollers 7'. Thus the setting of a cloth can be done skillfully. For setting, it is important in this instance that the sheets of a cloth are treated separately. Piled sheets cannot give a satisfactory result.

The sheets of the cloth 6 set in this way are piled up immediately after passing the setting zone A and transported through the pretreating zone B, where the sheets are wet heat treated further in a piled state under the additional supply of the high temperature treating solution from the nozzles 8 for the pretreatment of the cloth. The thus set and pretreated sheets of the cloth are then washed in a piled state in the washing zone C and taken out of the steamer body for the completion of the setting and pretreatment of a long cloth. It is possible to pretreat and wash a cloth effectively by piling several sheets thereof en bloc.

The setting and pretreatment of more than two sheets of a cloth can similarly be done. Further, while this example is done by using a high pressure steamer, a steamer at the ordinary pressure can similarly be employed. In this instance, a high pressure steamer is attached, and a high temperature water therefrom is propelled from the nozzles in the steamer body.

As described in the above, the present invention is to set, pretreat and wash several sheets of a long cloth en bloc continuously, in which the setting is done by separating the sheets, and the pretreatment and washing is done by piling of the sheets onto one another, so that a quite an excellent treatment can be carried out effectively. Moreover, in the present invention, the waste treating solution and washing water are recovered for the preparation of the treating solution, so that the treating agent, heat energy and water resource can be spared remarkably.

What is claimed is:

1. A method for setting and pretreating a cloth by a continuous process which comprises supplying a long cloth soaked with a treating solution continuously into a steamer body by piling up several sheets one on top of the other, steaming each cloth by separating these sheets just after the supply while applying a high temperature treating solution thereto, widening the sheets for setting the cloth, and then steaming the cloth by piling up the sheets once again during application of the high temperature treating solution still further thereto for pretreatment of the cloth, washing the cloth with washing water, and then finally taking the cloth out of the steamer body.

2. A method for setting and pretreating a cloth continuously according to claim 1, in which the treating solution comprises an aqueous caustic alkali solution.

3. A method for setting and pretreating a cloth continuously according to claim 1, in which the primary application of the treating solution to the cloth is done in a liquid seal tank provided at an inlet side seal mechanism of the steamer body.

4. A method for setting and pretreating a cloth continuously according to claim 1, in which the excess of treating solution and waste washing water are recovered for preparation of the treating solution.

* * * * *